US006492606B1

(12) United States Patent
MacLean

(10) Patent No.: US 6,492,606 B1
(45) Date of Patent: Dec. 10, 2002

(54) SNAP ACTION SWITCH

(75) Inventor: Alexander MacLean, Hingham, MA (US)

(73) Assignee: Electroswitch Corporation, Weymouth, MA (US)

( * ) Notice: Subject to any disclaimer, the term of this patent is extended or adjusted under 35 U.S.C. 154(b) by 0 days.

(21) Appl. No.: 09/934,307

(22) Filed: Aug. 21, 2001

(51) Int. Cl.[7] ..... H01H 5/04

(52) U.S. Cl. ..... 200/400; 200/11 R; 200/441; 200/43.04

(58) Field of Search ..... 200/11 R, 11 J, 200/17 R, 43.01, 43.04, 43.11, 400, 401, 405, 410, 449, 462–468, 336, 337, 440–442

(56) References Cited

U.S. PATENT DOCUMENTS

| | | | | |
|---|---|---|---|---|
| 1,495,849 A | | 5/1924 | Hodgkins | |
| 2,381,203 A | | 8/1945 | Bush | 200/67 |
| 2,509,311 A | | 5/1950 | Oaks | 200/140 |
| 2,534,007 A | | 12/1950 | Dietrich | 200/67 |
| 2,599,272 A | | 6/1952 | Minneci et al. | 74/97 |
| 2,752,446 A | | 6/1956 | Carlson | 200/67 |
| 2,838,636 A | | 6/1958 | Schwager | 200/145 |
| 3,432,632 A | | 3/1969 | Schenke | 200/67 |
| 3,471,669 A | | 10/1969 | Curtis | 200/168 |
| 3,479,474 A | | 11/1969 | Pajak | 200/61.44 |
| 3,562,454 A | | 2/1971 | Chance | 200/67 |
| 3,590,183 A | | 6/1971 | Leonard | 200/67 |
| 3,604,874 A | | 9/1971 | Puetz | 200/153 G |
| 3,614,358 A | | 10/1971 | Hermann | 200/150 R |
| 3,624,332 A | | 11/1971 | Van Benschoten | 200/164 |
| 3,636,291 A | | 1/1972 | Norden | 200/166 BG |
| 3,710,053 A | | 1/1973 | Auchapt et al. | 200/67 RB |
| 3,746,808 A | | 7/1973 | Bechtiger | 200/67 H |
| 4,295,024 A | | 10/1981 | Kamp | 200/288 |
| 4,315,118 A | | 2/1982 | Kramer et al. | 200/80 R |
| 4,798,922 A | | 1/1989 | Roberts | 200/400 |
| 4,841,106 A | | 6/1989 | Jacquet et al. | 200/402 |
| 4,853,506 A | | 8/1989 | Poschet et al. | 20/463 |
| 4,899,022 A | | 2/1990 | Leone et al. | 200/50 A |
| 5,021,615 A | * | 6/1991 | Muench et al. | 200/11 TC |
| 5,101,675 A | * | 4/1992 | Lauterwald | 200/400 |
| 5,123,291 A | | 6/1992 | Sonntagbauer | 74/2 |
| 5,488,212 A | * | 1/1996 | Fukushi et al. | 200/400 |
| 5,937,008 A | | 8/1999 | Wehrli, III et al. | 200/400 |
| 5,944,172 A | | 8/1999 | Hannula | 200/401 |
| 5,973,278 A | | 10/1999 | Werhli, III et al. | 200/308 |
| 6,124,557 A | * | 9/2000 | Kang | 200/11 R |

FOREIGN PATENT DOCUMENTS

| | | | |
|---|---|---|---|
| DE | 3630314 C1 | 2/1988 | H01H/5/06 |

* cited by examiner

*Primary Examiner*—Michael Friedhofer
(74) *Attorney, Agent, or Firm*—Wolf, Greenfield & Sacks, P.C.

(57) ABSTRACT

A snap action switch apparatus includes a snap action element that couples a handle to a switch contact apparatus having movable switch contacts so movement of the handle causes movement of the switch contacts. The snap action element may include two rotatably mounted arms that are coupled by a resilient member. One or more plates may shield the resilient member from one or more of the arms, e.g., to prevent mechanical interference during switch operation. The handle and movable contacts may have different ranges of motion, such as 90 degrees and 45 degrees, respectively, to provide verifiable and fast acting switching. The plates or other elements may provide an auxiliary bearing surface for the arms to provide more reliable operation.

41 Claims, 9 Drawing Sheets

CONTACT POS 1

CONTACT POS 2

KEY IN POS 1

SNAP ACTION SWITCH

FIELD OF THE INVENTION

This invention relates to snap action electrical switches.

DESCRIPTION OF RELATED ART

Electrical switches typically operate to open and close an electrical circuit by moving one or more contacts between contact positions. In some cases, the switch contacts may be damaged by slow movement of the contacts between switch positions or other improper actuation of the switch. For example, if a switch contact is moved slowly when opening a current-carrying circuit, arcing between contacts as the circuit is opened can cause the contacts to overheat, erode or otherwise be damaged. Some switch arrangements also allow switch contacts to be held in a transient state between on and off switch positions, i.e., teased between switch positions, and can cause contact damage.

SUMMARY OF THE INVENTION

In one aspect of the invention, an electrical switch apparatus includes a snap action element by which switch contacts can be rapidly moved between switch positions. In one aspect of the invention, the snap action element makes the switch apparatus teaseproof so that the switch contacts cannot be held in a transient position.

In one illustrative embodiment, a switch apparatus includes a handle, a snap action element and a switch contact apparatus. Rotary movement of the handle is transmitted by the snap action element to the switch contact apparatus so that movable contacts in the switch contact apparatus may be moved between contact positions, thereby opening or closing at least one electrical circuit. The handle is coupled to the snap action element so that rotation of the handle causes a first portion of the snap action element to rotate. Rotary motion of the first portion in the snap action element is transmitted via a resilient member to a second portion of the snap action element so that the second portion moves rapidly and in a teaseproof manner to a second position. The second portion may be coupled to the electrical switch contact apparatus so that the movable switch contacts are driven by the movement of the second portion.

In one aspect of the invention, a switching apparatus includes a housing having a handle end and a switch end. A handle drive arm is rotatably mounted at the handle end of the housing so that the handle drive arm has a range of rotary motion of approximately 90 degrees, and a switch drive arm is rotatably mounted at the switch end of the housing so that the switch drive arm has a range of rotary motion of approximately 45 degrees. A resilient member interconnects the handle drive arm and the switch drive arm so that rotation of the handle drive arm causes rotation of the switch drive arm. In one embodiment, a snap rotation of the switch drive arm is caused by rotation of the handle drive arm so that the switch drive arm moves rapidly between switch positions.

In another aspect of the invention, a switch apparatus includes a housing having a handle end and a switch end. A handle drive arm is rotatably mounted at the handle end of the housing, and a switch drive arm is rotatably mounted at the switch end of the housing. A spring interconnects the handle drive arm and the switch drive arm so that rotation of the handle drive arm causes a snap rotation of the switch drive arm. A plate is mounted between the spring and one of the handle drive arm and the switch drive arm, e.g., to shield the spring from either the handle drive arm or the switch drive arm during movement.

In another aspect of the invention, a switch apparatus includes a handle, an electrical contact apparatus having a movable switch contact, and a snap action element that transmits rotary motion of the handle to the electrical switch contact apparatus so that rotation of the handle causes movement of a movable switch contact in the electrical contact apparatus. The snap action element includes a first end plate, a handle arm stop plate fixed to the first end plate, and a handle drive arm rotatably mounted at a first end to the handle arm stop plate. A recess in the handle arm stop plate receives the handle drive arm. The snap action element also includes a second end plate fixed relative to the first end plate, a switch arm stop plate fixed to the second end plate, and a switch drive arm rotatably mounted at a first end to the switch arm stop plate. A recess in the switch arm stop plate receives the switch drive arm. A spring is connected at second ends of the handle drive arm and the switch drive arm opposite the first ends so that rotation of the handle drive arm causes snap rotation of the switch drive arm.

These and other aspects of the invention will be apparent from the following detailed description and the appended claims.

BRIEF DESCRIPTION OF THE DRAWINGS

Aspects of the invention are illustrated in connection with the following drawings, in which like numerals reference like elements, and wherein.

DETAILED DESCRIPTION

Aspects of the invention are described below in connection with a rotary electrical switch apparatus. That is, switching action is caused by rotary motion of a handle and switch contacts. However, it should be understood that various aspects of the invention are not limited to rotary-type switching applications. Instead, aspects of the invention may be applied to combination linear and rotary motion devices, or linear motion devices, for example.

Figure 1:
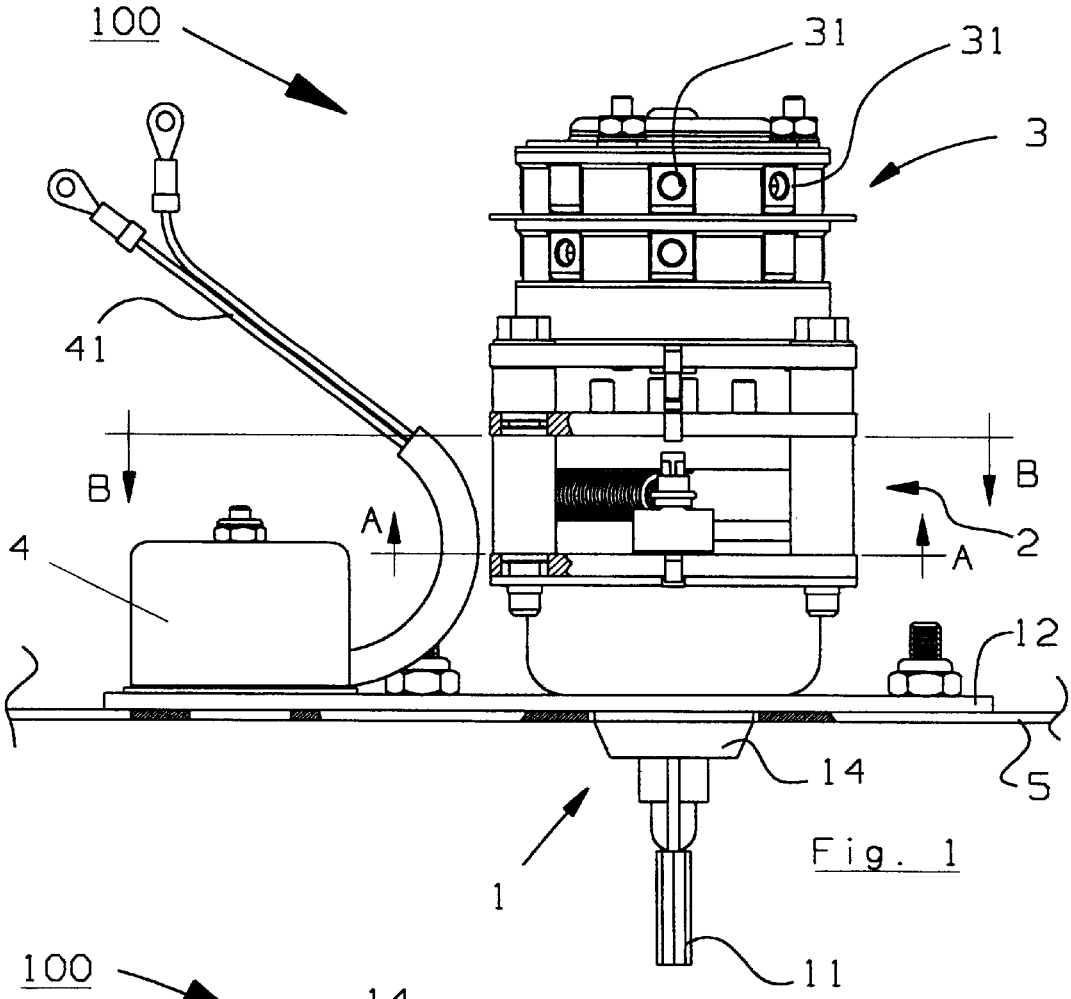
FIG. 1 shows a top view of a switch apparatus including a snap action element according to one aspect of the invention.

FIG. 1 shows an illustrative embodiment of a switch apparatus 100 that incorporates various aspects of the invention. As discussed above, this is only one illustrative embodiment that is used to describe various aspects of the invention. Thus, it should be understood that aspects of the invention are not necessarily limited to the illustrative embodiment of FIG. 1.

The switch apparatus 100 in FIG. 1 includes three main portions: a handle apparatus 1, a snap action element 2, and a switch contact apparatus 3. The switch apparatus 100 operates basically as follows. The handle apparatus 1 includes a key 11 or other handle that is turned by an operator. The key fits in a keylock 14, and turning of the key 11 is transmitted by the key lock 14 to the snap action element 2. The snap action element 2 couples the rotary motion of the key 11 to the switch contact apparatus 3 so that movable contacts in the switch contact apparatus 3 may be moved between contact positions, thereby opening or closing at least one electrical circuit, e.g., circuits connected through connectors 31. The snap action element 2 couples the key 11 and the movable contacts in the switch contact apparatus 3 so that the movable switch contacts move rapidly, or snap, between contact positions. Thus, after the key 11 is rotated a sufficient amount, contacts in the switch contact apparatus 3 rapidly move from one switch position to another. The snap action element 2 may also allow the switch contacts to be moved in a teaseproof manner, i.e., so that no manipulation of the key 11 will cause the switch contacts to be positioned between contact positions for a substantial period. Although not necessary, this illustrative embodiment includes an indicator 4 that indicates a switch contact position or other status information. For example, indicator leads 41 may be connected between electric circuits controlled by the switch contact apparatus 3 so that an indicator lamp 42 may illuminate to show a switch contact state.

Figure 2:
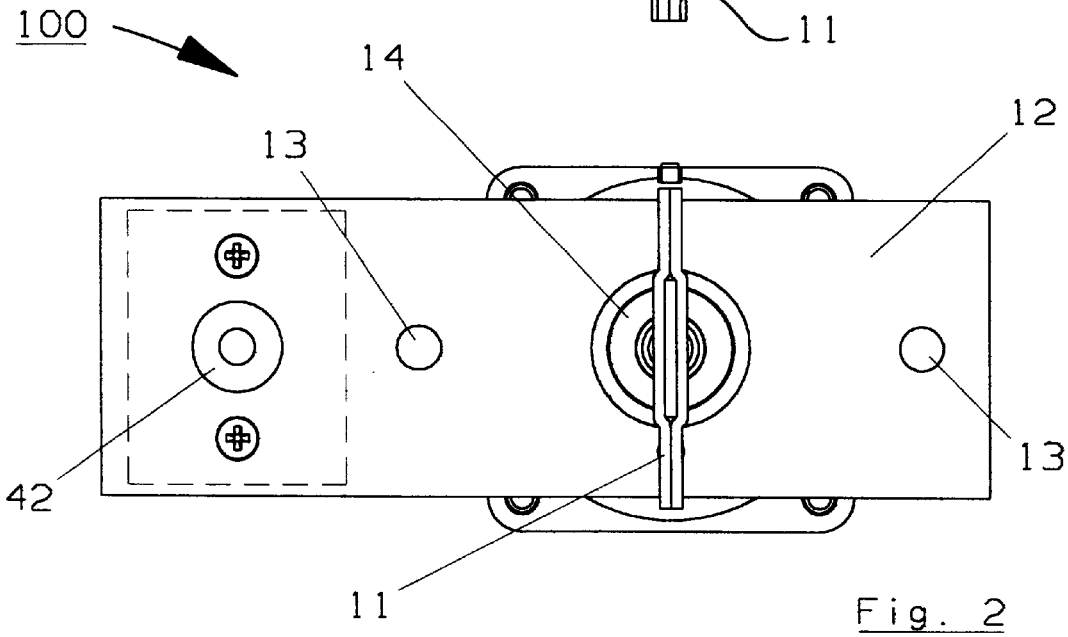
FIG. 2 shows a front view of the FIG. 1 apparatus.

As shown in FIG. 2, the switch apparatus 100 may include a mounting plate 12 having holes 13 by which the switch apparatus 100 may be mounted to a wall panel 5 or other surface. Of course, it will be understood that the switch apparatus 100 may be secured to any surface or any other object in any suitable way. In addition, the handle apparatus 1 in this embodiment includes a key lock 14 that receives the key 11, and if the key fits the key lock 14, the key lock 14 will transmit rotation of the key 11 to the snap action element 2. However, it should be understood that the handle apparatus may include any suitable arrangement for transmitting motion, whether rotary, linear or otherwise, to the snap action element 2. For example, the handle apparatus 1 may include a keyless handle and shaft that can be rotated.

Figure 4:
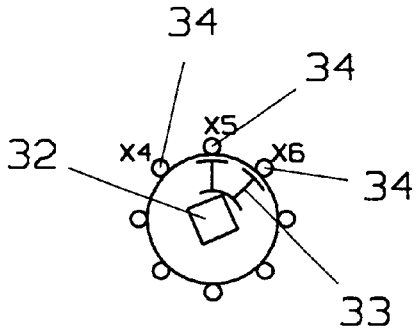
FIG. 4 shows a first switch contact position that corresponds to the handle position in FIG. 3.
Figure 6:
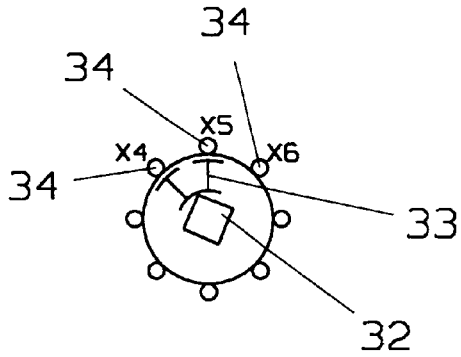
FIG. 6 shows a second switch contact position that corresponds to the second handle position shown in FIG. 5.
Figure 3:
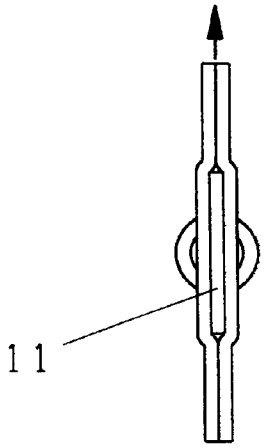
FIG. 3 shows a handle of the switch apparatus in a first position.
Figure 5:
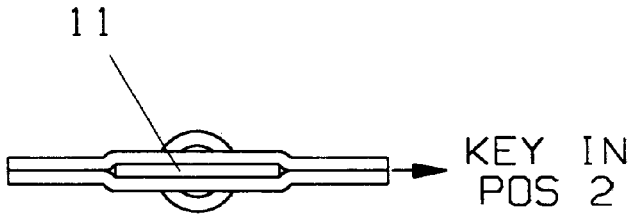
FIG. 5 shows a second handle position rotated 90 degrees from that shown in FIG. 3.

In one aspect of the invention, 90 degree rotation of a handle in the handle apparatus causes a 45 degree rotation of a moveable switch contact in the switch contact apparatus. Such an arrangement can be useful for an operator because a 90 degree rotation of a handle can be easily executed and used by the operator to visually and/or tactilely determine a current switch position. For example, FIG. 3 shows the key 11 in the switch apparatus 100 in a first position (POS1). When the key is in POS1, a contact shaft 32 and a pair of moveable contacts 33 fixed to the contact shaft 32 in the switch contact apparatus 3 are in a first position (POS1) as shown in FIG. 4 such that the moveable contacts 33 close a circuit between fixed contacts X5 and X6 (the fixed contacts, e.g., X5 and X6, may be linked to the external connectors 31 to allow wires or other circuit leads to be connected to the fixed contacts). When the key 11 is moved to a second position (POS2) shown in FIG. 5, rotary motion of the key 11 is transmitted through the snap action element 2 to the contact shaft 32 in the switch contact apparatus 3. Thus, when the key 11 is in POS2, the moveable contacts 33 are in a second position (POS2) as shown in FIG. 6. In position POS2, the moveable contacts 33 close a circuit between the fixed contacts X4 and X5. As can be seen in FIGS. 3 and 5, the 90 degree rotation of the key 11 between POS1 and POS2 can be easily distinguished by an operator either visually or by touch. Such confirmation of the switch position can be useful in certain applications, e.g., where the switch apparatus 100 is used to control the opening and closing of subway car doors. That is, subway car door operator must be careful to open and close the doors at an appropriate time and when riders are not positioned in the doorway. As a result, the operator often is viewing riders on the platform and/or in the subway cars when operating the switch apparatus 100 rather than viewing the key 11. The 90 degree rotation between POS1 and POS2 for the key 11 may be readily distinguished by the operator either by hand or eye so the operator can readily know the switch position and corresponding subway car door condition. The 45 degree rotation of the contact shaft 32 and moveable contacts 33 results in a faster switching operation than if the shaft 32 rotated through a larger degree of rotation between positions. Further, the 45 degree rotation is suitable to prevent short circuiting or arcing that may occur if the moveable contacts 33 are rotated through a relatively small angle of rotation for certain applications and is compatible with standard switch contact apparatuses 3 that have switch contact positions located at 45 degree relative rotations. Of course, it will be understood that the key 11 may rotate through different angles between positions and may result in different angles of rotation in the switch contact apparatus 3.

Figure 7:
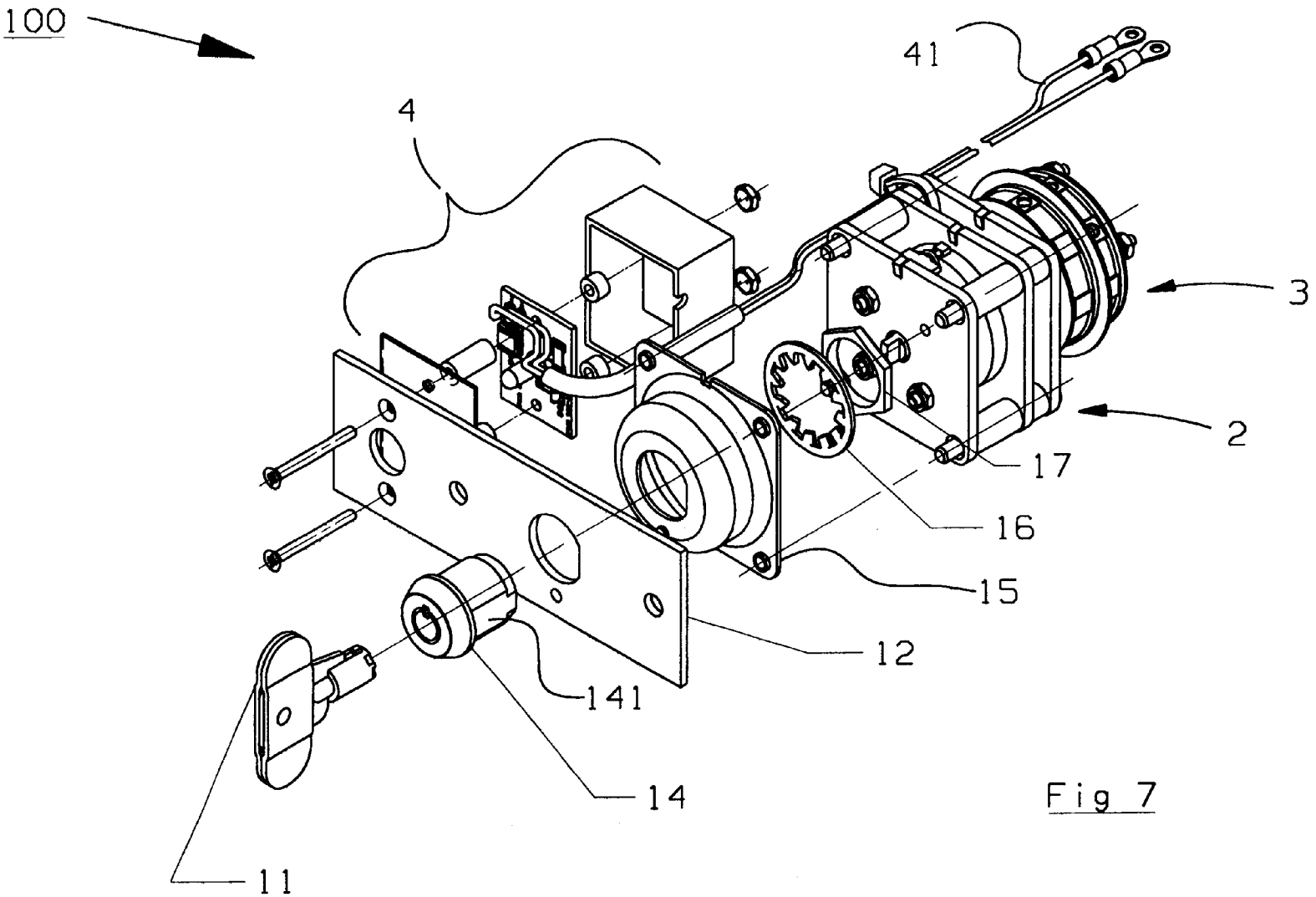
FIG. 7 shows a partial exploded view of the handle apparatus of the FIG. 1 embodiment.

FIG. 7 shows a partial exploded view of the handle apparatus 1 in the switch apparatus 100 shown in FIG. 1. This exploded view shows how the key lock 14 may be mounted to the mounting plate 12 by insertion through a hole in the mounting plate 12 and a hole in a bell mount 15. The holes in the mounting plate 12 and the bell mount 15 may be arranged so that the key lock 14 is less likely to rotate within the holes. In this illustrative embodiment, the key lock 14 is approximately cylindrical and has a flat 141. The holes in the mounting plate 12 and the bell mount 15 are approximately circular with a straight portion that engages with the flat 141 on the key lock 14 and prevents the key lock 14 from rotating in the holes. A lock washer 16 and nut 17 are threaded onto the key lock 14 and tightened to keep the key lock 14 and bell housing 15 in place. As mentioned above, the key 11 and key lock 14 may be replaced by a handle and shaft that are rotatably mounted to the mounting plate 12 and/or the snap action element 2. Thus, the handle apparatus 1 need not have a key and lock to resist unauthorized operation of the switch apparatus 100, although such security features may be desirable in some applications, such as the subway car door control application described above.

Figure 8:
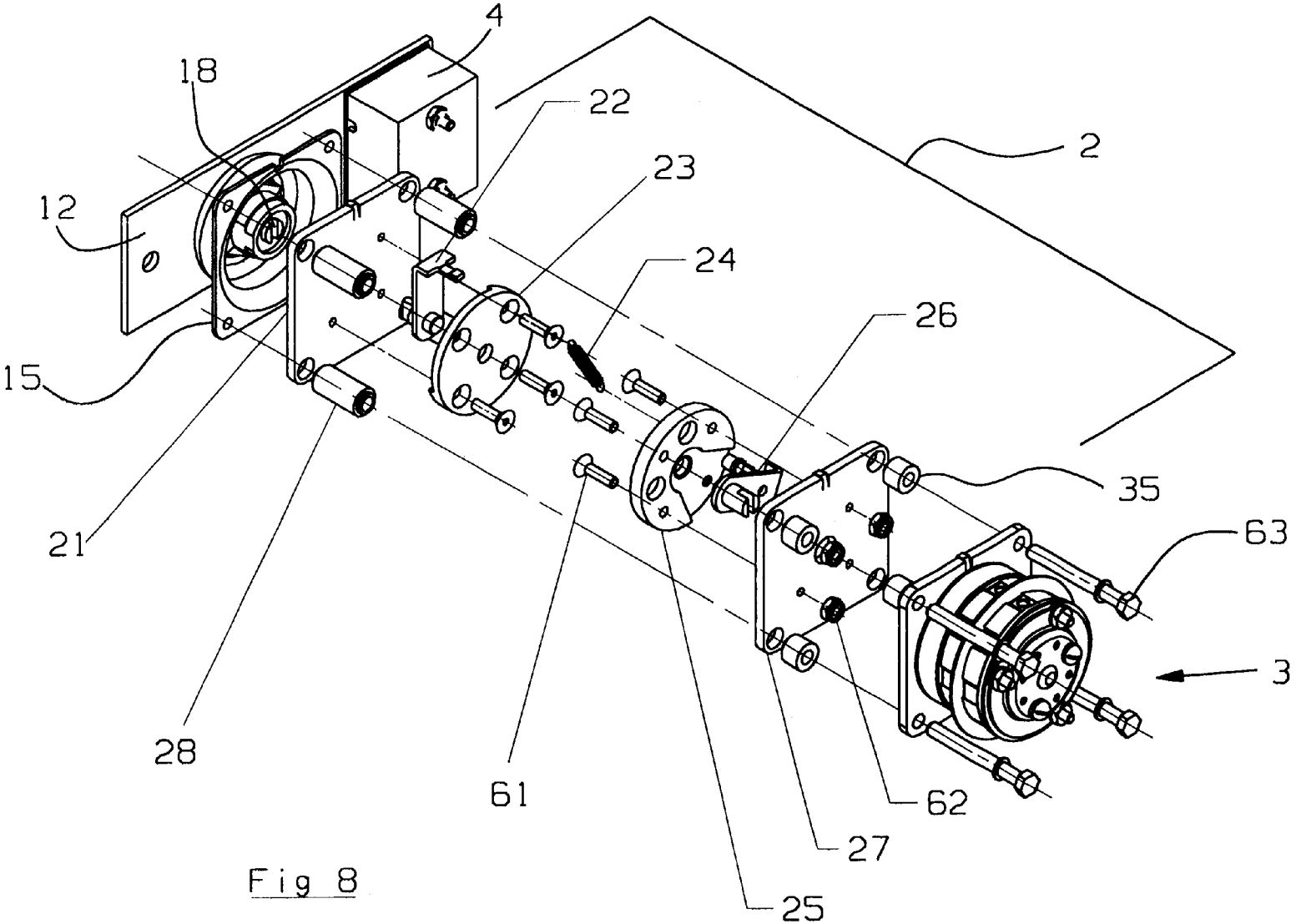
FIG. 8 shows a partial exploded view of the snap action element of the FIG. 1 embodiment.

FIG. 8 shows a partial exploded view of the snap action element 2 in the switch apparatus 100 shown in FIG. 1. As can be seen in this view, the key lock 14 has a handle drive shaft 18 extending from a rear end of the key lock 14. The handle drive shaft 18 in this embodiment has a clevis or other suitable feature that engages with a handle drive arm 22 in the snap action element 2 so that rotation of the key 11 is transmitted through the key lock 14 to the handle drive arm 22. A first end of the handle drive arm 22 is rotatably mounted to a handle arm stop plate 23, and is coupled at a second end to a coil spring 24. The handle arm stop plate 23 is fixed to a first end plate 21. The spring 24 is also coupled to a switch drive arm 26 that is rotatably mounted to a switch arm stop plate 25 that is fixed to a second end plate 27. As is discussed in more detail below, the spring 24 couples the handle drive arm 22 and the switch drive arm 26 so that rotation of the handle drive arm 22 results in a snap-type movement of the switch drive arm 26 between switch positions. Stop surfaces on the stop plates 23 and 25 limit the range of angular movement of the drive arms 22 and 26, e.g., to 90 degrees for the handle drive arm 22 and 45 degrees for the switch drive arm 26. The switch drive arm 26 is coupled to the contact shaft 32 (not shown in FIG. 8) of the switch contact apparatus 3 so that rotation of the switch drive arm 26 rotates the contact shaft 32 and the moveable contacts 33.

The snap action element is mounted to the switch contact apparatus 3 and the bell mount 15 by a set of bolts 63 that extend through spacers 35 and 28 and through holes in the end plates 21 and 27. In this embodiment, the spacers 28 may be about ⅝ inch long to provide a desired spacing between the end plates 21 and 27. Once assembled, the end plates 21 and 27 form a kind of housing for the snap action element 2. The stop plates 23 and 25 are mounted to the end plates 21 and 27, respectively, by screws 61 and self-locking nuts 62. It should be understood that portions of the snap action element 2 may be assembled in any suitable way using any suitable fasteners, such as adhesive, welding, and so on. Although spacers 28 are used to provide a desired spacing between the end plates 21 and 27, other arrangements may be used. For example, the end plates 21 and 27 may be arranged to form a box-like housing that encloses the snap action element 2, e.g., to protect the moving parts in the snap action element 2 from dirt, debris or other environmental conditions that may affect the performance of the snap action element 2.

In addition, the end plates 21 and 27 may be eliminated and the stop plates 23 and 25 arranged to perform the function of the end plates 21 and 27, e.g., provide a housing for the snap action element 2. In this case, a cap or other retainer may be used to ensure the drive arms 22 and 26 do not disengage from their rotatable mounts on the stop plates 23 and 25.

Figure 9:
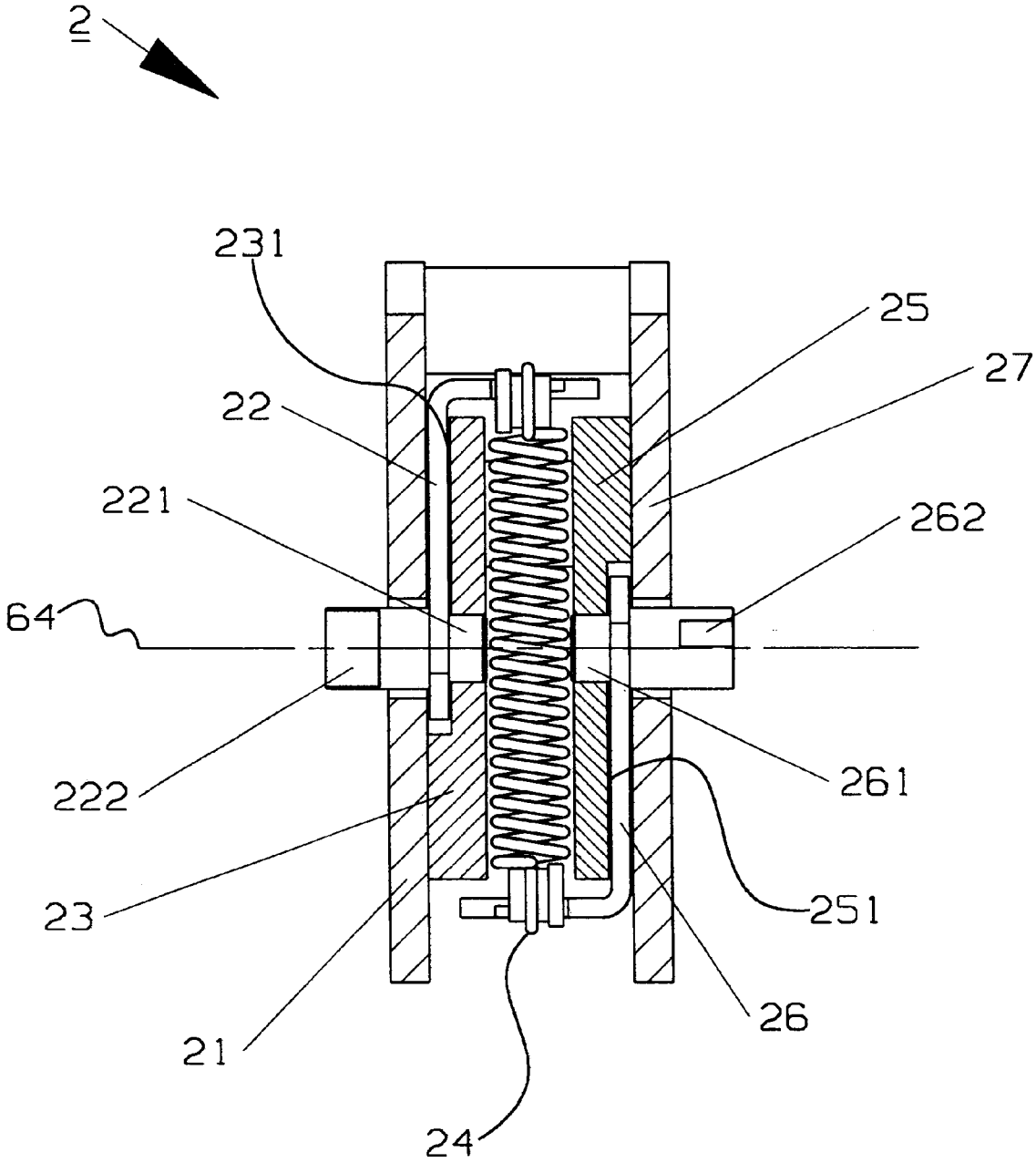
FIG. 9 shows a cross sectional view of the snap action element in the FIG. 1 embodiment.

FIG. 9 shows a cross sectional view of the snap action element 2 in this illustrative embodiment. As can be seen more clearly in FIG. 9, the handle drive arm 22 includes a shaft 221 that is free to rotate within holes in the end plate 21 and the stop plate 23. The shaft 221 closely fits the hole in the stop plate 23, and the bearing formed between the hole in the stop plate 23 and the shaft 221 may allow the handle drive arm 22 to rotate in a relatively friction-free manner. Although not present in this embodiment, one or more ball bearings, journal bearings or other devices to provide a suitable rotatable mount for the handle drive arm 22 may be used. In this embodiment, there is sufficient clearance between the hole in the end plate 21 and the portion of the shaft 221 that extends through the hole so that the shaft 221 does not bear on the hole. However, it should be understood that the shaft 221 may bear on the hole in the end plate 21 instead of, or in addition to, bearing on the hole in the stop plate 23. The bearing mount to the stop plate 23 in this embodiment may be advantageous since the bearing surface is closer to the spring 24, thereby shortening the effective lever arm of the spring 24 on the drive arm 22 and reducing the likelihood of the shaft 221 binding in the hole of the stop plate 23. However the handle drive arm 22 is mounted, it is mounted at a handle end of a housing, whether the housing is formed by the end plates 21 and 27, the stop plates 23 and 25 (e.g., whether or not the end plates 21 and 27 are used), or some other support for the drive arm 22. In this embodiment, the end plates 21 and 27 form part of a housing. If the end plates 21 and 27 are eliminated, the stop plates 23 and 25 may form part of a housing.

A tab 222 extends from one end of the shaft 221 and engages with a clevis or other corresponding feature on the handle drive shaft 18 to rotatably couple the drive shaft 18 and the handle drive arm 22. The handle drive arm 22 extends radially outward from the shaft 221 through a cavity between the end plate 21 and the stop plate 23 formed by a recess 231 in the stop plate 23. Outside of the cavity between the end plate 21 and the stop plate 23, the handle drive arm 22 turns about 90 degrees and extends toward the second stop plate 27.

The switch drive arm 26 is arranged similarly to the handle drive arm 22 and has a shaft 261 that extends through holes in the end plate 27 and the switch arm stop plate 25. A clevis 262 or other suitable feature engages with the contact shaft 32 in the switch contact apparatus 3. The shaft 261 closely fits the hole in the stop plate 25 and a relatively friction free rotatable mounting for the switch drive arm 26 is provided. Like the handle drive arm 22, the shaft 261 closely fits the hole in the stop plate 25, but sufficient clearance is provided between the shaft 261 and the hole in the end plate 27 so that the shaft 261 does not bear on the surface of the hole. Of course, like the handle drive arm 22, the switch drive arm 26 may be mounted in any suitable way, e.g., so a bearing is between the shaft 261 and one or both of the holes in the stop plate 25 and the end plate 27. Thus, however the switch drive arm 26 is mounted, the arm 26 is mounted at a switch end of a housing, e.g., the end plate 27 and/or stop plate 25.

The switch drive arm 26 extends radially outward through a cavity between the stop plate 25 and the end plate 27 formed by a recess 251 in the stop plate 25 and then extends toward the end plate 21. The spring 24 is in tension while connecting the handle drive arm 22 and the switch drive arm 26. Thus, the spring 24 exerts a moment of force on the handle drive arm 22 and the switch drive arm 26 perpendicular to their common rotational axis 64. (It should be understood that the arms 22 and 26 need not have a same rotational axis 64, but that their rotational axes, if present, may be arranged in any suitable way relative to each other.) That is, in the view shown in FIG. 9, the handle drive arm 22 and the switch drive arm 26 are urged by the spring to rotate clockwise in the plane of the drawing. This moment of force may be counteracted by the rotational mount of the drive arms 22 and 26 at the stop plates 23 and 25, i.e., the shafts 221 and 261 are rotatably mounted to the stop plates 23 and 25 so that the drive arms 22 and 26 resist the moment of force of the spring 24. In addition, in one aspect of the invention, the portion of the drive arms 22 and 26 extending through the cavity between their respective end plates 21 and 27 and stop plate 23 and 25 may bear on the stop plates 23 and 25 in the recesses 231 and 251 to counteract the moment exerted by the spring 24. These additional bearing surfaces provided by the stop plates 23 and 25 in the cavity may prevent binding of the drive arms 22 and 26 at their rotational mounts in the holes in the stop plates 23 and 25. Friction between the drive arms 22 and 26 and the bearing surfaces of the stop plates 23 and 25 in the cavity may be minimized by positioning the bearing surface between the drive arms 22 and 26 and the stop plates 23 and 25 as far away from the axis of rotation 64 of the drive arms 22 and 26 as possible. Friction may also be reduced by including suitable materials in the drive arms 22 and 26 and/or the stop plates 23 and 25. For example, the drive arms 22 and 26 may be made of steel or other metal while the stop plates 23 and 25 are made of a plastic material, such as an acetyl plastic. Of course, it will be understood that appropriate lubricants, bearings or other suitable materials or devices may be used to provide a suitable mounting of the drive arms 22 and 26.

The handle drive arm 22 and switch drive arm 26 in this embodiment have similar sizes and configurations, although such similarity is not necessary. The shafts 221 and 261 of the arms 22 and 26 may have a stepped diameter as shown in FIG. 9 so that the portion of the shaft 221 and 261 extending through the end plate 21 and 27 has a diameter of approximately ¼ inch, and the portion of the shaft 221 and 261 extending through the stop plate 23 and 25 has a diameter of approximately 3⁄16 inch. The portion of the arms 22 and 26 that extend radially from the shafts 221 and 261 are about 1⁄16 inch thick, 7⁄16 inch wide and about ¾ inch long. The bent portion of the arms 22 and 26 that couples with the spring 24 is also about 1⁄16 inch thick, 7⁄16 wide (the dimension perpendicular to the plane of FIG. 9) and about ½ inch long. The spring is approximately ¼ inch in diameter and 1 inch long in an untensioned state. The stop plates 23 and 25 have an approximately 1.5 inch diameter and are approximately 3⁄16 inch thick with the recesses 231 and 251 being approximately 1⁄16 inch deep. It should be understood, however, that although these dimensions for the snap action element 2 have been found particularly effective, other dimensions for the various elements may be used.

Another inventive feature illustrated in FIG. 9 is that the spring 24 is shielded from motion of at least one of the handle drive arm 22 and the switch drive arm 26 when the handle drive arm 22 rotates. For example, the stop plates 23 and 25 shield the spring 24 from the drive arms 22 and 26 when the spring 24 and/or the drive arms 22 and 26 move. As a result, the chance of interference between moving parts in the snap action element 2 is minimized.

Figure 10:
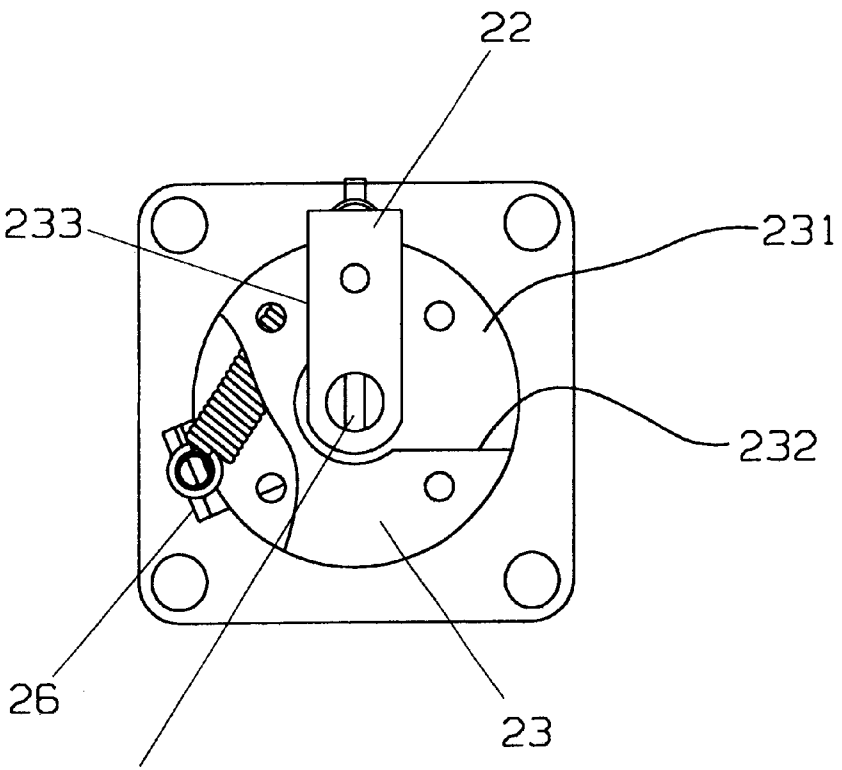
FIG. 10 shows a view of the snap action element along the line A—A in FIG. 1.

FIG. 10 shows an end view of the snap action element as viewed from the handle end of the switch apparatus 100 along the line A—A in FIG. 1. The handle drive arm 22 can be seen mounted within the recess 231 formed in the handle arm stop plate 23. In this embodiment, the recess 231 provides the cavity within which the handle drive arm 22 extends radially from the shaft 221. As discussed above, one or more portions of the recess 231 may provide a bearing surface against which the handle drive arm 22 bears. The bearing surface within the recess 231 may be provided, as also discussed above, near the outer periphery of the stop plate 23 to reduce friction between the handle drive arm 22 and the bearing surface in the recess 231.

The recess 231 includes stop surfaces 232 and 233 that limit the angular range of movement of the handle drive arm 22. In this illustrative embodiment, the stop surfaces 232 and 233 are arranged at a 90 degree angle relative to each other so that the handle drive arm 22 is limited to a 90 degree angle range of motion. Of course, the stop surfaces 232 and 233 may be arranged in other ways and at other angles to provide any suitable range of motion for the drive arm 22. Moreover, the stop surfaces 232 and 233 need not be arranged at a 90 degree angle relative to each other to provide a 90 degree range of motion for the drive arm 22. In some cases, the arrangement of the stop surfaces 232 and 233 may depend on the shape, dimensions or other features of the drive arm 22.

In one aspect of the invention, the stop surfaces 232 and 233 may be made of a material that reduces mechanical wear between the drive arm 22 and the stop surfaces 232 and 233 that may occur when the drive arm 22 impacts the stop surfaces under the snap action of the spring 24. For example, the stop plate 23 may be made of an acetyl plastic while the handle drive arm 22 may be made of steel. This arrangement has been found to minimize mechanical wear between the drive arm 22 and the stop surfaces 232 and 233 through at least 100,000 switch operations. Providing a broad contact area between the handle drive arm 22 and the stop surfaces 232 and 233 may also minimize mechanical wear since the force exerted on the handle drive arm 22 by the stop surfaces 232 and 233 may be spread over a broader contact area.

Figure 11:
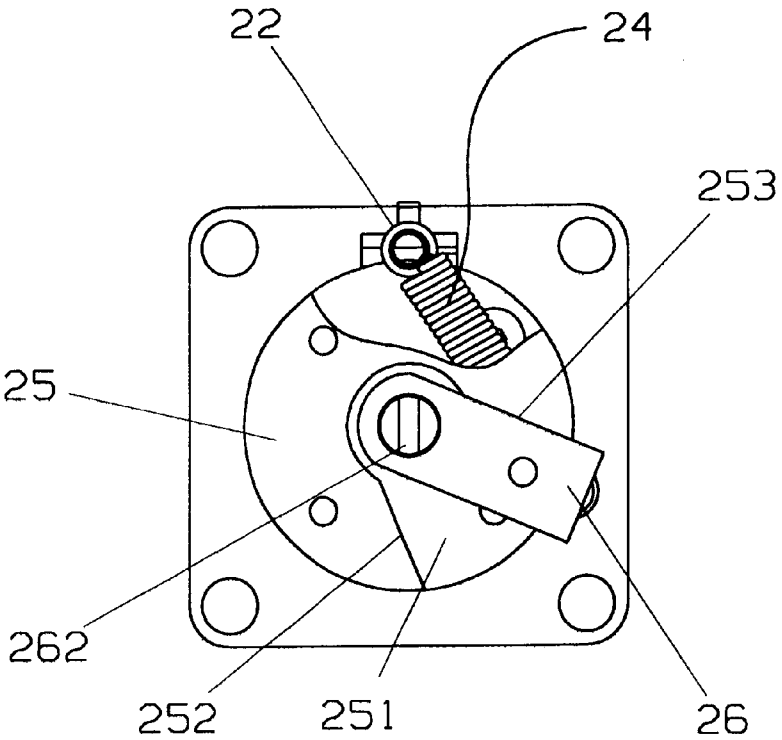
FIG. 11 shows a view of the snap action element along the line B—B shown in FIG. 1.

FIG. 11 shows an end view of the snap action element 2 from the switch contact apparatus side along the line B—B shown in FIG. 1. Similar to the handle drive arm 22, the switch drive arm 26 is mounted within the recess 251 in the switch arm stop plate 25. The switch arm stop plate 25 includes stop surfaces 252 and 253 that in this example are arranged at a 45 degree angle relative to each other so that the switch drive arm 26 has a 45 degree angle range of motion. As discussed above, the stop surfaces 252 and 253 may be arranged to provide different ranges of motion for the switch drive arm 26. A 45 degree range of motion is provided for the switch drive arm 26 in this embodiment since the switch positions in the switch contact apparatus 3 are arranged at 45 degree angles relative to each other.

As with the handle arm stop plate 23, the switch arm stop plate 25 may be made of acetyl plastic, provide a bearing surface within the recess 251 for the switch drive arm 26 and/or provide a relatively broad contact surface between the stop surfaces 252 and 253 and the switch drive arm 26 to minimize mechanical wear. In this illustrative embodiment, the stop surfaces are made approximately ½ inch long with a width of approximately 1⁄16 inch, although other suitable dimensions may be used.

Figure 12:
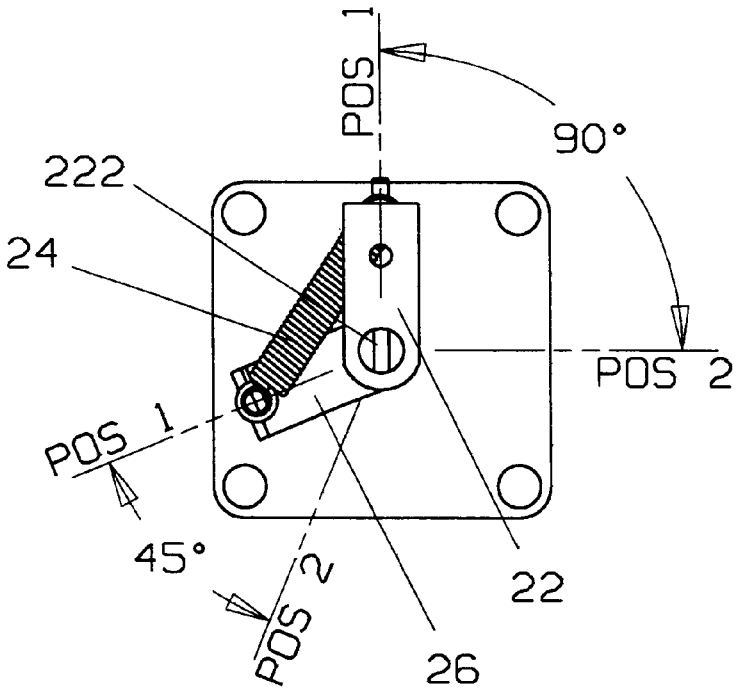
FIG. 12 shows the drive arms in the snap action element in a first position.

FIGS. 12–15 show the drive arms 22 and 26 in the snap action element 2 in different switching states and are used below to describe an operation of this illustrative embodiment. In FIG. 12, the handle drive arm 22 is in a first position (POS1) and the switch drive arm 26 is also in a first position (POS1). The spring 24 is in tension, thereby biasing the handle drive arm 22 and the switch drive arm 26 to rotate toward their respective stops on the stop plates at POS1. Thus, referring back to FIGS. 3 and 4, the key 11 in the switch apparatus 100 is in POS1 and the moveable contacts 33 are in POS1.

Figure 13:
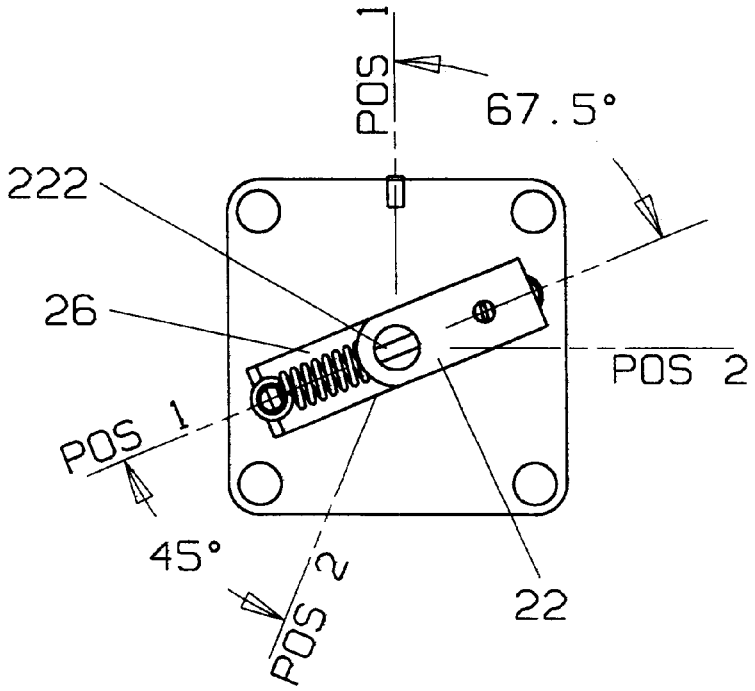
FIG. 13 shows the drive arms in the snap action element in a transient position when moving from the first position to a second position.
Figure 14:
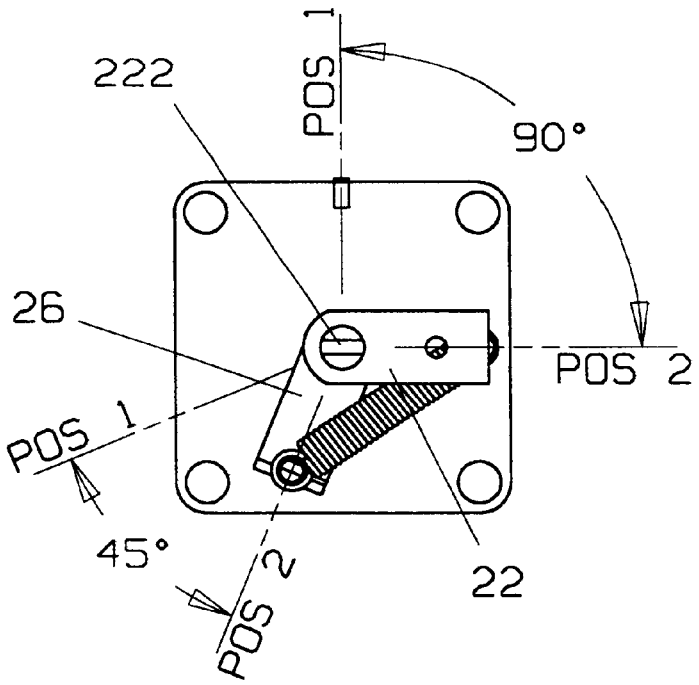
FIG. 14 shows the drive arms in the snap action element in the second position.
Figure 15:
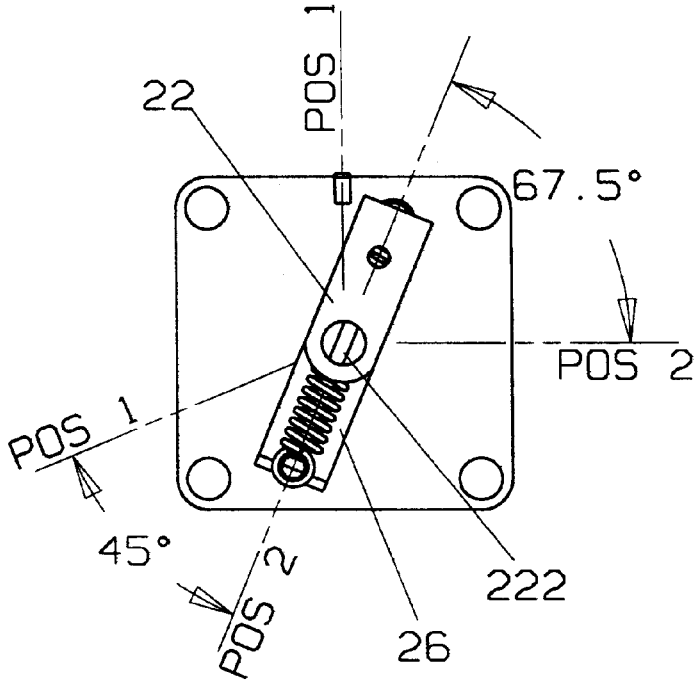
FIG. 15 shows the drive arms in the snap action element in a transient position when moving from the second to the first position.

In FIG. 13, the handle drive arm 22 is in a transient position between the first position (POS1) and the second position (POS2). That is, the handle drive arm 22 has been rotated by rotation of the key 11 by approximately 67.5 degrees clockwise toward POS2. The switch drive arm 26 remains in POS1 as the handle drive arm 22 is rotated up to 67.5 degrees from POS1 because the spring 24 has not yet passed the axis of rotation 64 of the drive arms 22 and 26. Thus, the tension of the spring 24 on the ends of the drive arms 22 and 26 tends to urge the drive arms to POS1. However, once the handle drive arm 22 is rotated more than approximately 67.5 degrees from POS1, the spring 24 passes the axis of rotation 64 of the drive arms 22 and 26. At this point, the spring 24 biases the drive arms 22 and 26 toward each other and to rotate toward the second position (POS2) as shown in FIG. 14. Accordingly, once the key 11 is turned approximately 67.5 degrees from POS1, the spring 24 snaps the switch drive arm 26 from its stop at POS1 to the stop at POS2. The bias of the spring 24 also urges the handle drive arm 22 toward its stop at POS2. Since the handle drive arm 22 and the key 11 are coupled together, the key position provides an indication of the current switch contact position.

To move the switch contacts from POS2 back to POS1, the key 11 is rotated approximately 67.5 degrees from POS2 toward POS1. If the key 11 is rotated less than approximately 67.5 degrees and released, the spring 24 will bias the handle drive arm 22 back to POS2. Once the handle drive arm 22 is rotated sufficiently to have the spring 24 cross the axis of rotation 64 for the drive arms, the spring 24 snaps the switch drive arm 26 and the handle drive arm 22 to POS1, the position shown in FIG. 12.

The switching operation of the snap action element may provide a tease proof switching of the contacts in the switch contact apparatus because the switch drive arm 26 moves between bistable switch states regardless of the handle drive arm 22 position. That is, the switch drive arm 26 is either in POS1 or POS2, but does not remain stationary between POS1 and POS2. As a result, an operator cannot cause the switch drive arm 26 to remain for a substantial amount of time between POS1 and POS2. This tease proof feature may extend the life of the switch contacts because they cannot be held between switch positions by operation of the key 11.

As discussed above, the handle drive arm 22 moves through a range of approximately 90 degrees because the stop surfaces 232 and 233 prevent further movement of the handle drive arm 22. Similarly, the switch drive arm 26 moves through 45 degrees because the stop surfaces 252 and 253 prevent further movement. Of course, it will be understood that the angular range of motion of the drive arms may be adjusted to any suitable angular range. In addition, the angular ranges of motion determined by the stop plates 23 and 25 are arranged so that switch actuation is caused by rotation of the handle drive arm 22 approximately 67.5 degrees from its current position (whether the current position is POS1 or POS2). However, the relative positions of the ranges of motion of the handle drive arm and the switch drive arm may be adjusted so that switch actuation is caused by different degrees of rotation of the handle drive arm. For example, the 45 degree range of motion of the switch drive arm 26 may be rotated clockwise from that shown in FIG. 12 so that a rotation of more than 67.5 degrees of the handle drive arm 22 from POS1 is required to snap the switch drive arm 26 to POS2. Correspondingly, a rotation of less than 67.5 degrees of the handle drive arm 22 from POS2 toward POS1 will be required to snap the switch drive arm 26 from POS2 to POS1.

Figure 16:
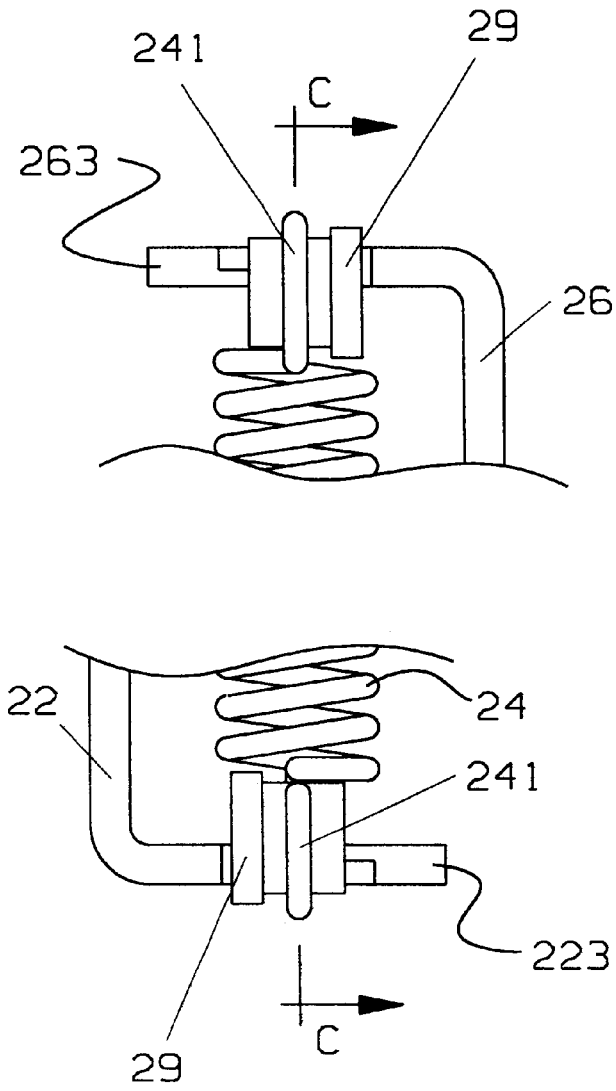
FIG. 16 shows a detail of the connection between the resilient member and the drive arms in the snap action element.
Figure 17:
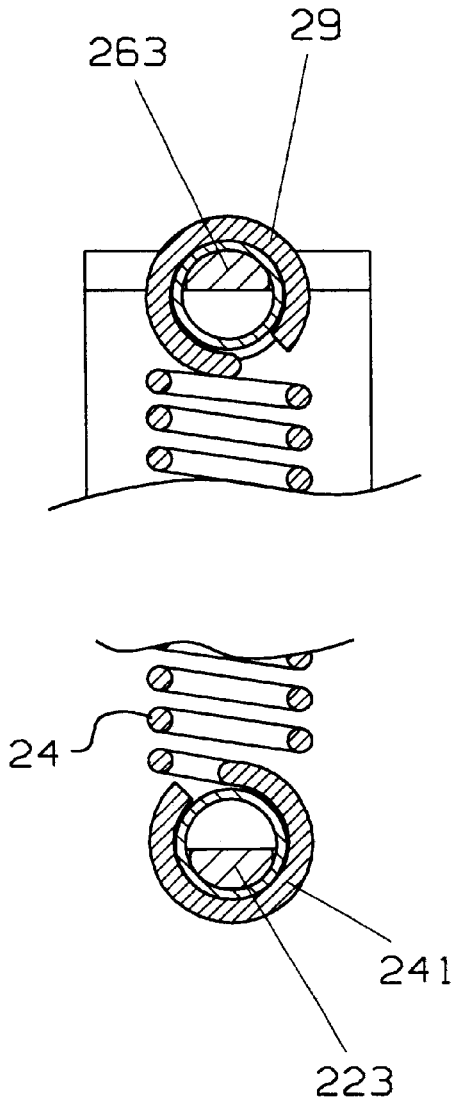
FIG. 17 shows a cross sectional view of the connection between the resilient member and the drive arms along the line C—C in FIG. 16.

FIG. 16 shows a detailed view of an illustrative embodiment of the interconnection between the spring 24 and the drive arms 22 and 26. In this illustrative embodiment, the drive arms 22 and 26 each have a pin 223 and 263 that carries a bearing 29, such as a nylon sleeve, positioned between the pin 223 and 263 and looped ends 241 of the spring 24. The bearing 29 may provide smoother action of the snap action element 2, as well as reduce wear of the spring 24 and/or the drive arms 22 and 26. As can be seen in the cross-sectional view along line C—C shown in FIG. 17, the pins 223 and 263 of the drive arms 22 and 26 may be formed by peening or otherwise deforming the ends of the drive arms to provide a circular or other curved bearing surface for the bearing 29. This curved bearing surface may provide reduced wear between the bearing 29 and the spring 24 or the drive arms 22 and 26.

While various aspects of the invention have been described above in connection with illustrative embodiments, various modifications, alterations and other changes may be made to the illustrative embodiments and are intended to be within the scope of the invention. Therefore, the embodiments described herein should not be construed as limiting, but are merely used to illustrate various aspects of the invention.

What is claimed is:

1. A switching apparatus comprising:

a housing having a handle end and a switch end;

a handle drive arm rotatably mounted at the handle end of the housing so that the handle drive arm has a range of rotary motion;

a switch drive arm rotatably mounted at the switch end of the housing so that the switch drive arm has a range of rotary motion; and a resilient member interconnecting the handle drive arm and the switch drive arm so that rotation of the handle drive arm causes a snap rotation of the switch drive arm;

wherein the resilient member is shielded from at least one of the handle drive arm and the switch drive arm during rotation of the handle drive arm.

2. The apparatus of claim 1, wherein the handle drive arm and the switch drive arm rotate about a common axis of rotation.

3. The apparatus of claim 1, further comprising a switch contact apparatus having movable switch contacts coupled to the switch drive arm for rotary motion.

4. The apparatus of claim 1, further comprising a key lock and a key, the key lock coupled to the handle drive arm so that rotation of the key in the key lock causes rotation of the handle drive arm.

5. The apparatus of claim 1, further comprising:

a handle arm stop plate including plastic stop surfaces that define a 90 degree range of rotary motion for the handle drive arm.

6. The apparatus of claim 1, further comprising:

a switch arm stop plate including plastic stop surfaces that define a 45 degree range of rotary motion for the switch drive arm.

7. The apparatus of claim 1, further comprising:

a handle arm stop plate including stop surfaces arranged to limit the range of rotary motion of the handle drive arm to approximately 90 degrees; and a switch arm stop plate including stop surfaces that are arranged to limit the range of rotary motion of the switch drive arm to approximately 45 degrees.

8. The apparatus of claim 7, wherein at least one stop surface in the handle arm stop plate and the switch arm stop plate is approximately ½ inch long.

9. The apparatus of claim 1, wherein rotation of the handle drive arm less than approximately 68 degrees from a first end of the range of rotary motion of the handle drive arm causes rotation of the switch drive arm.

10. The apparatus of claim 1, wherein the resilient member is a coil spring connected under tension between the handle drive arm and the switch drive arm.

11. The apparatus of claim 1, further comprising a plate mounted between the resilient member and one of the handle drive arm and the switch drive arm.

12. The apparatus of claim 11, further comprising a first plate mounted between the resilient member and the handle drive arm and a second plate mounted between the resilient member and the switch drive arm, the first and second plates respectively shielding the resilient member from the handle drive arm and the switch drive arm during rotation of the handle drive arm.

13. The apparatus of claim 12, wherein the first plate includes stop surfaces to define the range of rotary motion of the handle drive arm, and the second plate includes stop surfaces to define the range of rotary motion of the switch drive arm.

14. The apparatus of claim 1, further comprising a bearing at a connection between the resilient member and one of the handle drive arm and the switch drive arm.

15. The apparatus of claim 1, wherein the handle drive arm and the switch drive arm respectively have a first end rotatably mounted to the housing and a second end connected to the resilient member, further comprising:

an approximately planar bearing surface arranged to contact one of the handle drive arm and the switch drive arm between the first and second ends.

16. A switch apparatus comprising:

a housing having a handle end and a switch end;

a handle drive arm rotatably mounted at the handle end of the housing;

a switch drive arm rotatably mounted at the switch end of the housing;

a spring interconnecting the handle drive arm and the switch drive arm so that rotation of the handle drive arm causes a snap rotation of the switch drive arm; and a plate mounted between the spring and one of the handle drive arm and the switch drive arm.

17. The apparatus of claim 16, wherein the plate shields the spring from motion of one of the handle drive arm and the switch drive arm during rotation of the handle drive arm.

18. The apparatus of claim 16, wherein the handle drive arm and the switch drive arm respectively have a first end rotatably mounted relative to the housing and a second end connected to the spring, and wherein the plate provides a bearing surface for one of the handle drive arm and the switch drive arm between the first and second ends.

19. The apparatus of claim 16, wherein the plate includes at least one stop surface to define a range of rotary motion of one of the handle drive arm and the switch drive arm.

20. The apparatus of claim 16, comprising a first plate mounted between the spring and the handle drive arm and a second plate mounted between the spring and the switch drive arm, the first and second plates respectively shielding the spring from the handle drive arm and the switch drive arm during rotation of the handle drive arm.

21. The apparatus of claim 20, wherein the first plate includes stop surfaces to define a range of rotary motion of the handle drive arm, and the second plate includes stop surfaces to define a range of rotary motion of the switch drive arm.

22. The apparatus of claim 21, wherein the range of rotary motion of the handle drive arm is approximately 90 degrees, and the range of rotary motion of the switch drive arm is approximately 45 degrees.

23. The apparatus of claim 22, wherein rotation of the handle drive arm less than approximately 68 degrees from a first end of the range of rotary motion of the handle drive arm causes a snap rotation of the switch drive arm from a first position at one stop surface on the second plate to a second position at another stop surface on the second plate.

24. The apparatus of claim 23, wherein the first and second plates are plastic.

25. The apparatus of claim 20, wherein the handle drive arm and the switch drive arm respectively have a first end rotatably mounted to the first and second plates and a second end connected to the spring, and wherein the first and second plates respectively provide a bearing surface for the handle drive arm and the switch drive arm between the first and second ends.

26. The apparatus of claim 16, wherein the handle drive arm and the switch drive arm have a common axis of rotation and rotation of the handle drive arm causes the spring to cross from one side of the axis of rotation to the other, thereby causing snap rotation of the switch drive arm from a first position to a second position.

27. A switch apparatus comprising:

a handle;

an electrical contact apparatus having at least one movable switch contact; and a snap action element that transmits rotary motion of the handle to the electrical switch contact apparatus so that rotation of the handle causes movement of a movable switch contact in the electrical contact apparatus, the snap action element comprising:

a first end plate, a handle arm stop plate having a recess and being fixed relative to the first end plate, a handle drive arm rotatably mounted at a first end to the handle arm stop plate and positioned at least partially in the recess in the handle arm stop plate, a second end plate fixed relative to the first end plate, a switch arm stop plate having a recess and being fixed relative to the second end plate, a switch drive arm rotatably mounted at a first end to the switch arm stop plate and positioned at least partially in the recess in the switch arm stop plate, and a spring connected at second ends of the handle drive arm and the switch drive arm opposite the first ends so that rotation of the handle drive arm causes snap rotation of the switch drive arm.

28. The apparatus of claim 27, wherein the handle drive arm and the switch drive arm are free to rotate about a common axis of rotation.

29. The apparatus of claim 27, wherein the handle is a key, the apparatus further comprising a key lock coupled to the handle drive arm so that rotation of the key in the key lock causes rotation of the handle drive arm.

30. The apparatus of claim 27, wherein the handle arm stop plate includes plastic stop surfaces that define an approximately 90 degree range of rotary motion for the handle drive arm.

31. The apparatus of claim 27, wherein the switch arm stop plate includes plastic stop surfaces that define an approximately 45 degree range of rotary motion for the switch drive arm.

32. The apparatus of claim 27, wherein:

the handle arm stop plate includes stop surfaces arranged to limit a range of rotary motion of the handle drive arm to approximately 90 degrees; and the switch arm stop plate includes stop surfaces that are arranged to limit a range of rotary motion of the switch drive arm to approximately 45 degrees.

33. The apparatus of claim 32, wherein at least one stop surface in the handle arm stop plate and the switch arm stop plate is approximately ½ inch long.

34. The apparatus of claim 27, wherein rotation of the handle drive arm less than approximately 68 degrees from a first end of a range of rotary motion of the handle drive arm causes rotation of the switch drive arm.

35. The apparatus of claim 27, wherein the spring is a coil spring connected under tension between the second ends of the handle drive arm and the switch drive arm.

36. The apparatus of claim 27, wherein the spring is shielded from the handle drive arm by the handle arm stop plate and is shielded from the switch drive arm by the switch arm stop plate.

37. The apparatus of claim 27, wherein the handle arm stop plate includes stop surfaces to define a range of rotary motion of the handle drive arm, and the switch arm stop plate includes stop surfaces to define a range of rotary motion of the switch drive arm.

38. The apparatus of claim 27, further comprising a bearing at a connection between the spring and one of the handle drive arm and the switch drive arm.

39. The apparatus of claim 27, wherein the handle arm stop plate and the switch arm stop plate respectively abut the first and second end plates so that each recess respectively forms a cavity between the handle arm stop plate and the first end plate, and between the switch arm stop plate and the second end plate, the handle drive arm and switch drive arm extending radially in a respective cavity.

40. The apparatus of claim 27, wherein a portion of the recesses in handle arm stop plate and the switch arm stop plate respectively provide a planar bearing surface arranged to contact one of the handle drive arm and the switch drive arm between the first and second ends.

41. The apparatus of claim 27, wherein the handle drive arm and the switch drive arm have a common axis of rotation and rotation of the handle drive arm causes the spring to cross from one side of the axis of rotation to the other, thereby causing snap rotation of the switch drive arm from a first position to a second position.

* * * * *